US007755510B2

(12) United States Patent
Bilimoria et al.

(10) Patent No.: US 7,755,510 B2
(45) Date of Patent: Jul. 13, 2010

(54) INTELLIGENT SYSTEM FOR MANAGING VEHICULAR TRAFFIC FLOW

(75) Inventors: Yaz Bilimoria, Carlsbad, CA (US); Gabriel Gomes, Berkeley, CA (US)

(73) Assignee: Mergex Traffic Systems Corporation, Carlsbad, CA (US)

( * ) Notice: Subject to any disclaimer, the term of this patent is extended or adjusted under 35 U.S.C. 154(b) by 332 days.

(21) Appl. No.: 11/676,300

(22) Filed: Feb. 18, 2007

(65) Prior Publication Data

US 2008/0180281 A1 Jul. 31, 2008

Related U.S. Application Data

(63) Continuation-in-part of application No. 11/627,933, filed on Jan. 26, 2007, now abandoned.

(60) Provisional application No. 60/881,608, filed on Jan. 22, 2007.

(51) Int. Cl.
*G08G 1/00* (2006.01)

(52) U.S. Cl. ..... 340/932; 701/119; 340/910

(58) Field of Classification Search ..... 340/932, 340/907; 701/96

See application file for complete search history.

(56) References Cited

U.S. PATENT DOCUMENTS

| | | | | |
|---|---|---|---|---|
| 3,529,284 | A * | 9/1970 | Villemain | 340/932 |
| 3,593,262 | A * | 7/1971 | Spencer | 340/932 |
| 6,559,774 | B2 | 5/2003 | Bergan et al. | |
| 6,825,778 | B2 | 11/2004 | Bergan et al. | |
| 7,025,525 | B2 * | 4/2006 | Van Der Poel | 404/1 |
| 2002/0049118 | A1 | 4/2002 | Vornehm et al. | |
| 2003/0201909 | A1 | 10/2003 | Hilliard | |
| 2004/0068393 | A1 | 4/2004 | Lawrence | |
| 2004/0260455 | A1 | 12/2004 | Dort | |
| 2005/0015203 | A1 | 1/2005 | Nishira | |
| 2005/0137783 | A1 | 6/2005 | Dort | |
| 2005/0179527 | A1 | 8/2005 | Schofield | |
| 2005/0187701 | A1 | 8/2005 | Baney | |
| 2005/0278098 | A1 | 12/2005 | Breed | |
| 2006/0235597 | A1 * | 10/2006 | Hori et al. | 701/96 |
| 2007/0290887 | A1 * | 12/2007 | Pleasanton | 340/908 |

OTHER PUBLICATIONS

Turksma, S., "Follow Me, Safe Infrastructure-Guided Lane Merging", 8th World Congress on Intelligent Transport Systems, 2001.

* cited by examiner

*Primary Examiner*—Brian A Zimmerman
*Assistant Examiner*—Sara Samson
(74) *Attorney, Agent, or Firm*—Charles F. Reidelbach, Jr.

(57) ABSTRACT

A novel vehicular traffic management system that requires no special equipment in any vehicle is disclosed. More specifically, the novel system may be used when approaching a lane closure or lane reduction. The system comprises sequencing signaling devices along the roadway and a central controller. The controller commands the signaling devices to flash (or signal) according to a calculated trajectory. Vehicles traveling along side the signaling devices can pace their speed with cues from the signaling devices. Through this pacing, the system can position the vehicles such that they can merge safely and efficiently. The system can be expanded to merge more than just two lanes. Further refinements to the system include external connections that may include GPS tracking and Internet down/uploading. A feasibility condition/determination can be used with the system to make the system even more robust and efficient.

14 Claims, 10 Drawing Sheets

INTELLIGENT SYSTEM FOR MANAGING VEHICULAR TRAFFIC FLOW

1. RELATED APPLICATIONS/RELATED DOCUMENTS

The present application is a continuation-in-part of U.S. application Ser. No. 11/627,933 filed on Jan. 26, 2007 now abandoned, which claims the benefit of Provisional Application Ser. No. 60/881,608, filed on Jan. 22, 2007. The present patent application is also related to the non-published United States disclosure document number 568968 entitled "*Intelligent System for Regarding Traffic Flow in Highway Work Zones*" filed on Jan. 27, 2005 by inventor Yaz Bilimoria. The contents of the related applications and disclosure document are incorporated herein by reference.

2. FIELD OF THE INVENTION

The present invention relates to devices and methods for managing vehicular traffic flow.

3. BACKGROUND OF THE INVENTION

Managing the efficient traffic flow over the nation's roadways is an extremely complex problem. In several metropolitan areas, roadways have reached, and even exceeded, their capacities further complicating the problem. One area that is particularly difficult to manage is the merging of two or more lanes of traffic into a single lane. This can occur for a variety of reasons including roadway maintenance/construction that requires unfettered access to a lane of traffic thereby requiring closure of the lane, or the design of the roadway is such that one lane is required to merge with another, a feature that is very common with roadway on-ramps.

Traffic flow in these merge zones frequently gets congested and backed up as drivers in two or more adjacent lanes maneuver their vehicles to squeeze into a single merging lane. Bottlenecks occur particularly when traffic density is high. This can result in traffic getting backed up upstream of the merge zone causing delays and increasing the potential for collisions. A cause for this traffic congestion and slowdown is the "me-first" psychology of drivers. Generally speaking, drivers are unwilling to allow their neighbors in the adjacent lane to merge into their lane by appropriately adjusting their vehicle speed to open up a large enough gap to allow the merge to occur smoothly Several methods exist to address the problems inherent in merge zones. For example, there are several systems employing smart or intelligent automobiles. The basic premise of all these systems is that the automobile of the future will be equipped with a device that will allow it to communicate with other automobiles in its vicinity on the roadway. Such automobiles will then be able to operate in a cooperative manner by communicating with each other and thereby allowing maximum safe throughput of vehicles on the roadway. Examples of this type of systems are disclosed in United States Patent Application numbers 2004/0260455, 2004/0068393 and 2005/0137783. The significant shortcoming to these systems is that they require all vehicles to be equipped with special devices. Not only will this take several years to implement, it may be impossible to economically retrofit older vehicles. This may be especially true in areas with a hospitable climate, such as southern California, where there are large populations of well-maintained antique and vintage vehicles.

U.S. Pat. No. 6,559,774 discloses a work zone safety system and method. The system is adapted to selectively flash a suitable warning, e.g., "DO NOT PASS" or "MERGE LEFT" or "MERGE RIGHT." A significant shortcoming to this system is that it fails to provide the motorist with any guidance on the proper speed they should attain for a safe and efficient lane merge.

U.S. Pat. No. 6,825,778 discloses a variable speed limit system for use in work zones. The system includes at least two spaced-apart stations, where each station includes a plurality of sensors to gather information. The station includes a controller which is programmed to analyze data which is received from the sensors and to derive an optimum speed limit at a selected location adjacent the work zone. The station then displays to the motorist through a message board the optimum speed. A significant shortcoming of this system is that it is difficult for a motorist to read the message board and maneuver their vehicle to the optimum speed, while simultaneously attempting to safely merge. Also, several motorists may have a speedometer that is either not working or is severely mis-calibrated, such that attempting to implement the speed shown on the message board would be a futile, if not dangerous task.

What is needed therefore is a traffic control system that provides motorists with simple and effective guidance regarding the proper speed needed to achieve a safe and efficient lane merge. Moreover, the system should not require any special equipment on any vehicle, such that the system may be implemented immediately.

4. SUMMARY OF THE INVENTION

The present disclosure provides a vehicular traffic system for a merge zone. The merge zone includes a secondary lane merging into a primary lane. The vehicular traffic system includes a central controller, a series of primary lane signaling devices connected to the central controller, and a series of secondary lane signaling devices connected to the central controller. The central controller performs the step of activating the series of primary lane signaling devices based on a primary lane trajectory such that motorists traveling in the primary lane take visual cues from the series of primary lane signaling devices causing the primary lane motorist to be positioned according to the primary lane trajectory. The central controller also performs the step of activating the series of secondary lane signaling devices based on a secondary lane trajectory such that motorists traveling in the secondary lane take visual cues from the series of secondary lane signaling devices causing the secondary lane motorist to be positioned according to the secondary lane trajectory.

In one embodiment the system also comprises speed sensors that are also connected to the central controller. The sensors may provide the controller with real time information on the conditions in the merge zone. In another embodiment, the system includes external connections to real-time GPS tracking and/or Internet down/uploading. These external connections can also provide the controller with conditions in the merge zone.

In another embodiment the acceleration, velocity and position trajectories for vehicles may be based on a stepwise acceleration profile. These trajectories may be used by the system to safely produce a gap between vehicles such that a merging vehicle can safely merge. The system may be more robust and efficient by implementing a feasibility condition/determination. The system may be expanded to merge more than just two lanes.

The present disclosure also provides a method for merging traffic in a merge zone wherein the merge zone comprises a positioning region and a merging region. The method comprises obtaining variables regarding the characteristics of the traffic entering the merge zone and determining based on the variables whether it is feasible to merge the traffic. If it is feasible to merge the traffic, the method comprises constructing appropriate primary lane trajectories and secondary lane trajectories, sending the primary lane trajectories to a series of primary lane signaling devices, and sending the secondary lane trajectories to a series of secondary lane signaling devices.

5. BRIEF DESCRIPTION OF THE DRAWINGS

Figure 6:
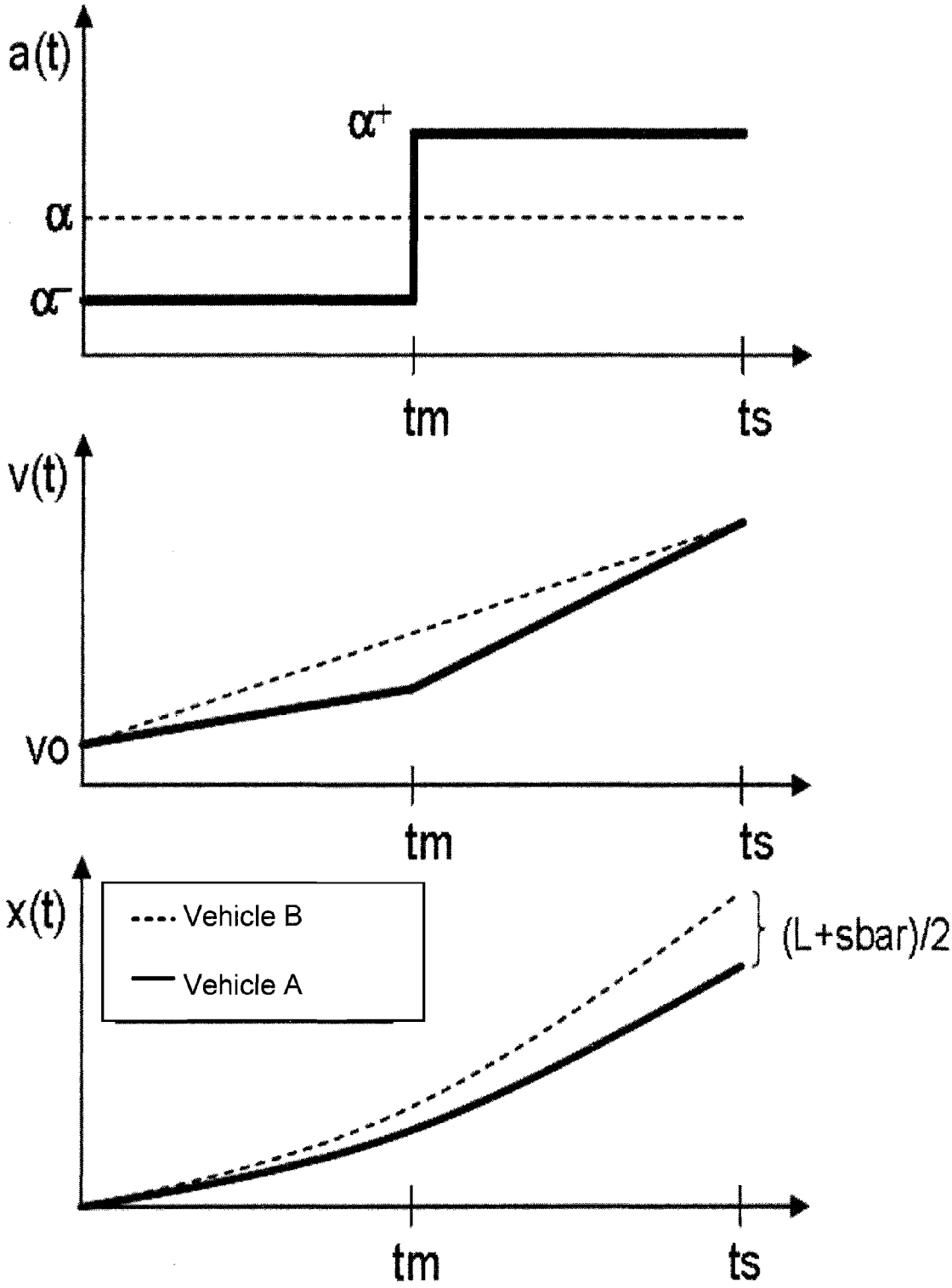

FIG. 6 presents the acceleration, velocity and position graphs of a pair of vehicles corresponding to a trajectory calculated by the novel traffic management system.

Figure 7:
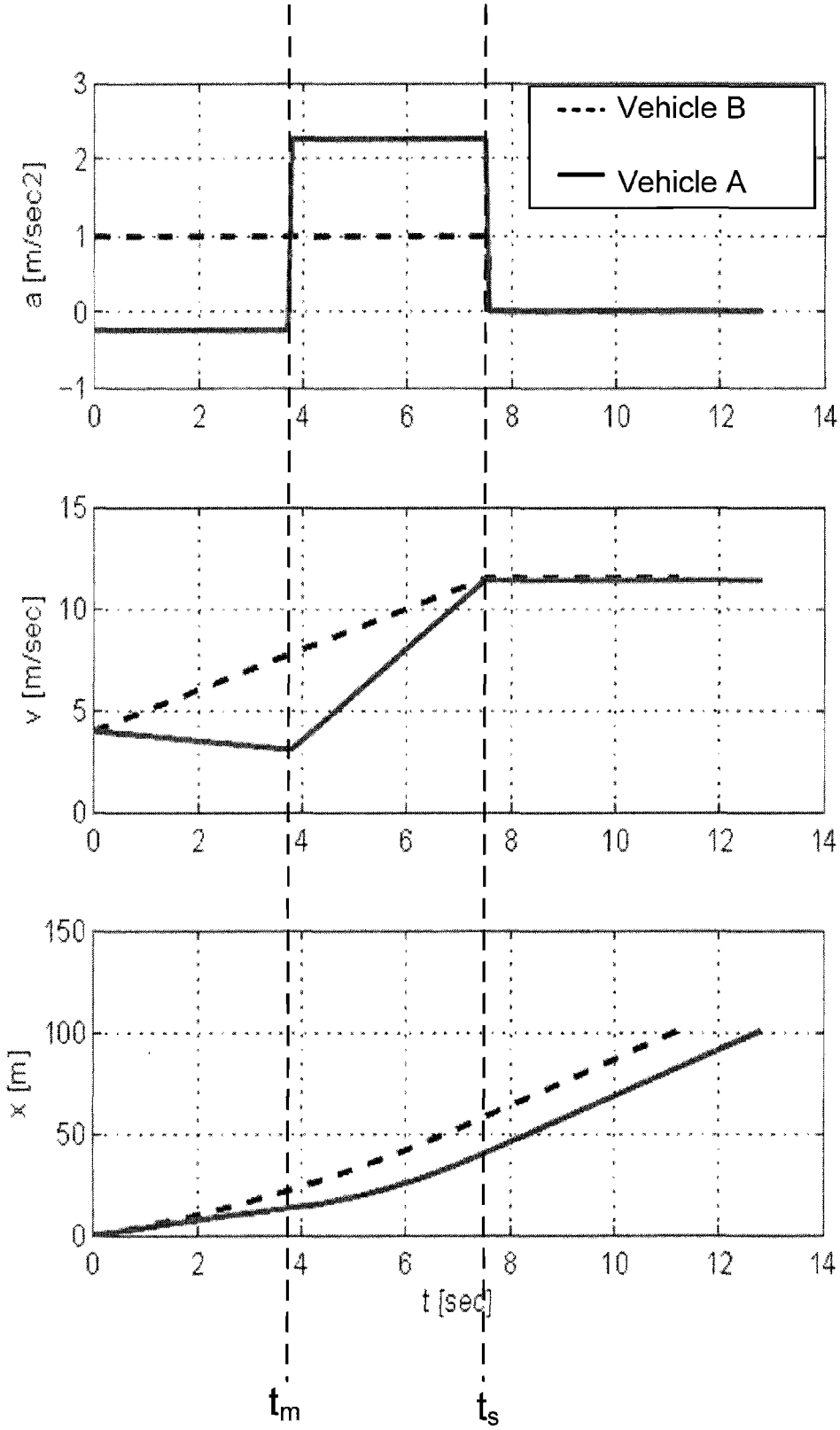

FIG. 7 presents the acceleration, velocity and position graphs of a pair of vehicles corresponding to a trajectory calculated by the novel traffic management system.

Figure 8:
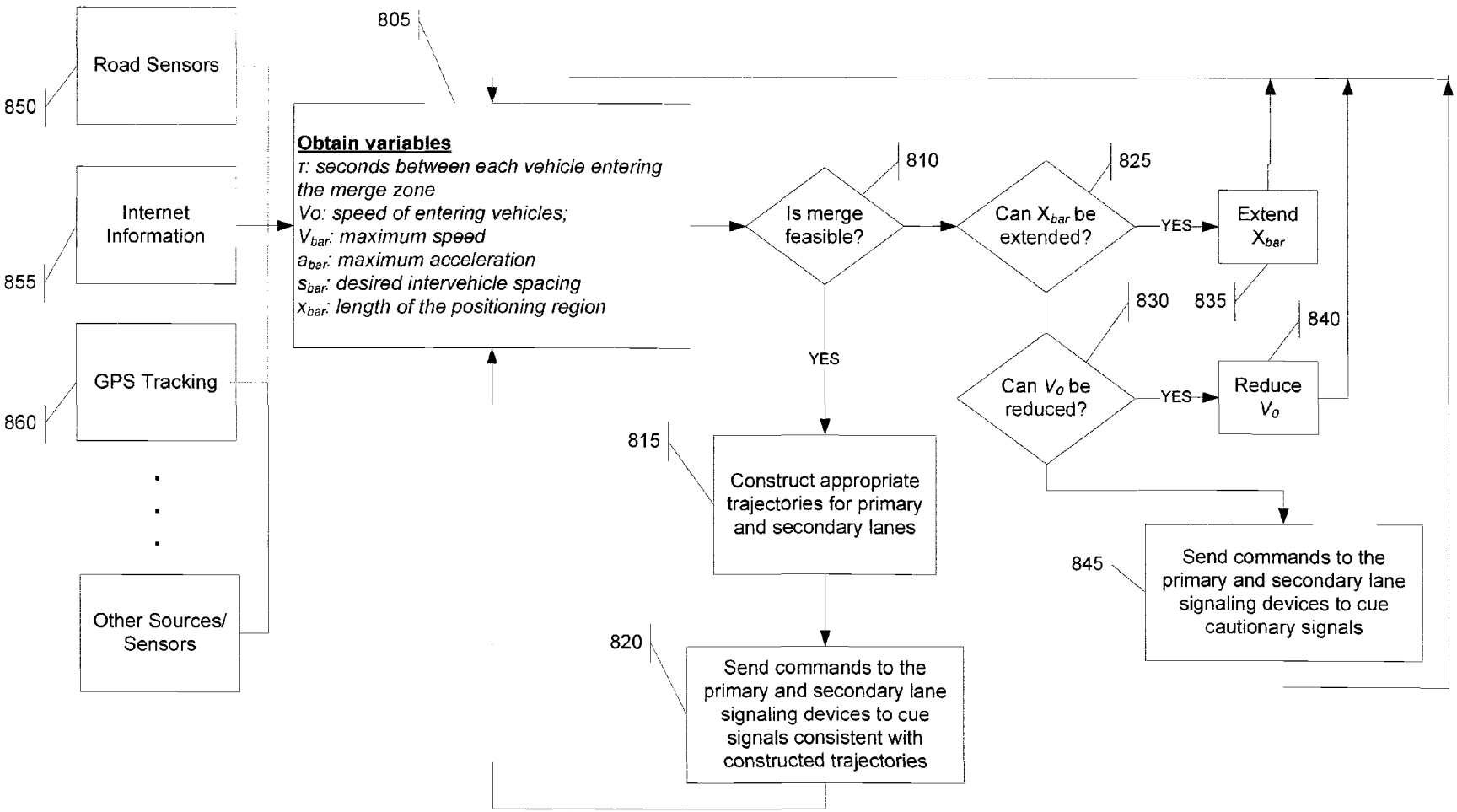

FIG. 8 is a flow chart that implements a feasibility determination as part of the novel traffic management system.

6. DETAILED DESCRIPTION

What is described below is a novel vehicular traffic management system that requires no special equipment in any vehicle. Instead, appropriate sequencing signaling devices are placed along the roadway to provide guidance to vehicles to allow them to merge safely and efficiently when approaching a lane closure or lane reduction. It provides motorists with a cue that can be easily understood and followed thereby creating a collaborative situation that fosters smooth traffic flow on previously congested roadways. The system allows motorists to pace their vehicles with the objective of opening up a gap (or maintaining a gap) between consecutive vehicles in the primary lane—i.e., the lane that is continuous through the merge zone. Vehicles in the secondary—i.e., the lane that disappears in the merge zone—can merge into the primary lane by dropping into the opened gap.

Figure 1:
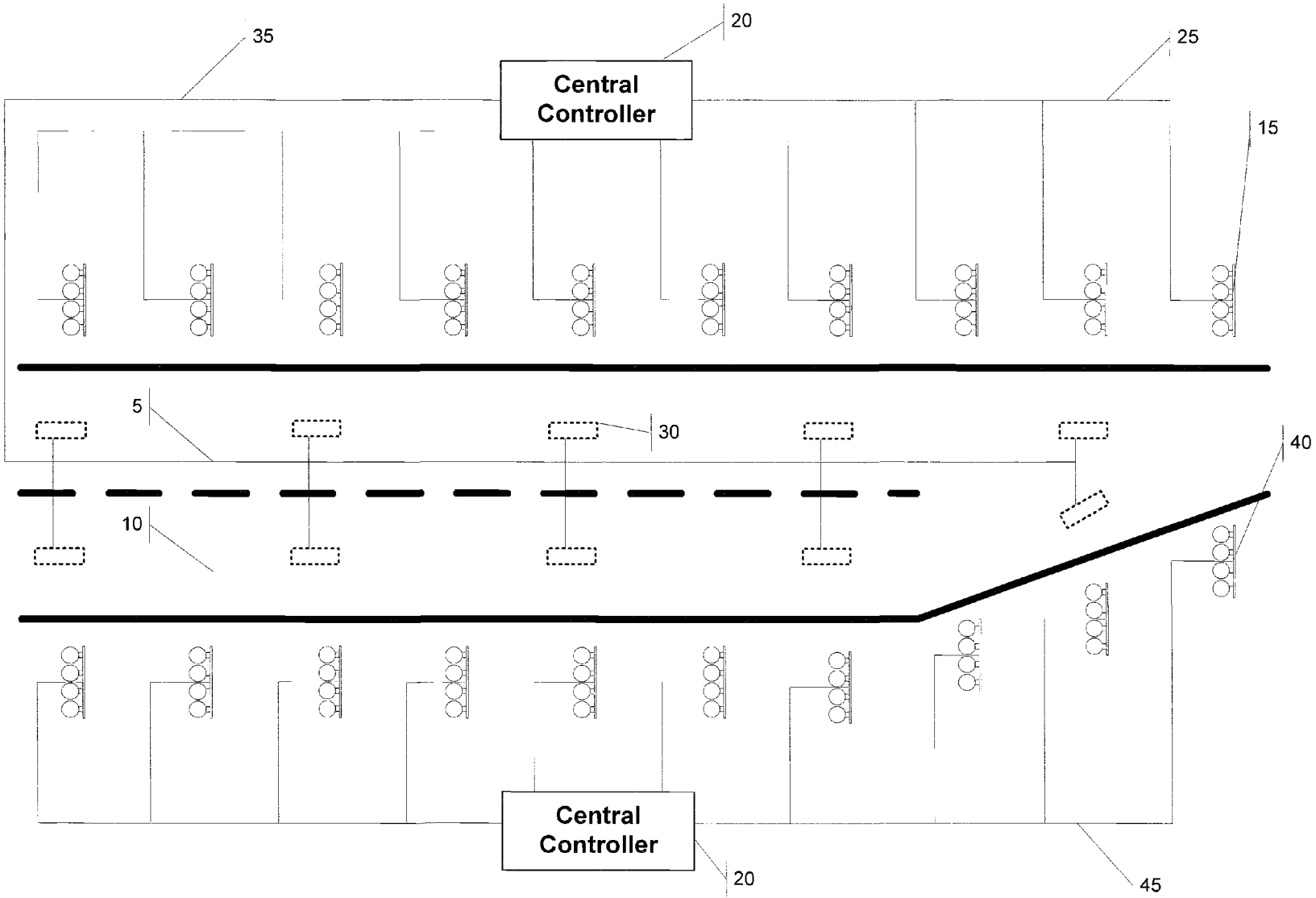
FIG. 1 illustrates an overview of a novel traffic management system.

An overview of the system is provided in FIG. 1. The secondary lane (10) merges into the primary lane (5). Along the length of the primary lane (5) are a series of primary lane signaling devices (15) that are connected to a central controller (20) via a primary communication channel (25). The secondary lane (10) includes a series of secondary lane signaling devices (40) that are also connected to the central controller (20) via a secondary communications channel (45). The length along the primary lane (5) and the secondary lane (10) in which the signaling devices are activated is the merge zone. Optionally, the primary lane (5) and/or the secondary lane (10) may include speed sensors (30) to detect vehicular speed. In fact, road sensors similar to the speed sensors (30) are already in use throughout several roadways, and in several cases the road sensors are embedded in the roadway. While the speed sensors (30) are shown within the primary and secondary lanes, the speed sensors (30) may be in the lane or adjacent to the lane according to various embodiments within the scope of the appended claims. The speed sensors (30) are also connected to the central controller (20) via a speed sensor communication channel (35). The communication channels (25), (45), and (35) may be a physical connection or a wireless connection.

Figure 2A:
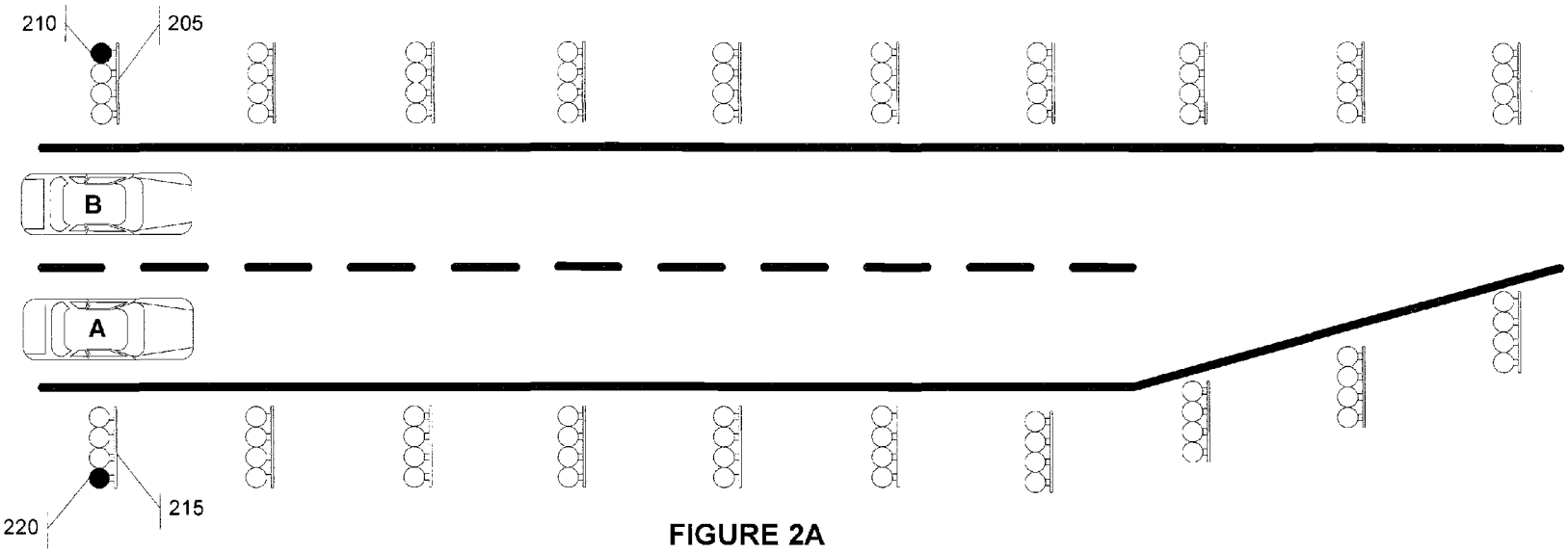
FIGS. 2A-2F illustrates the operation of the novel traffic management system, namely the positioning of the vehicles from cues constructed by the novel traffic management system.
Figure 2B:
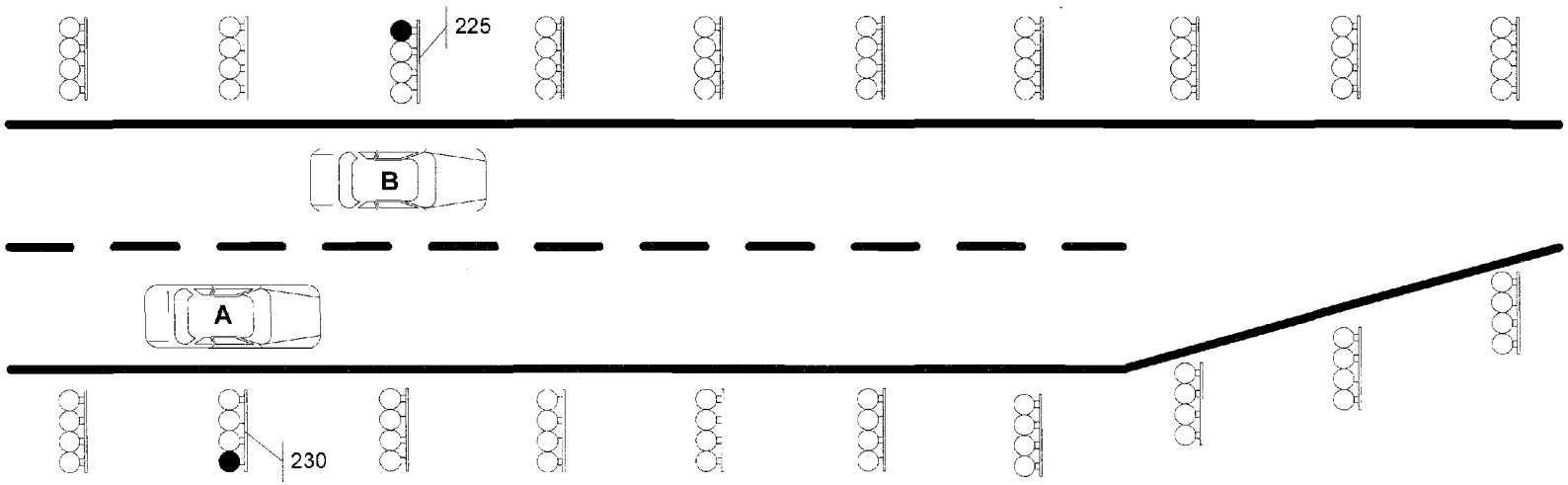
Figure 2C:
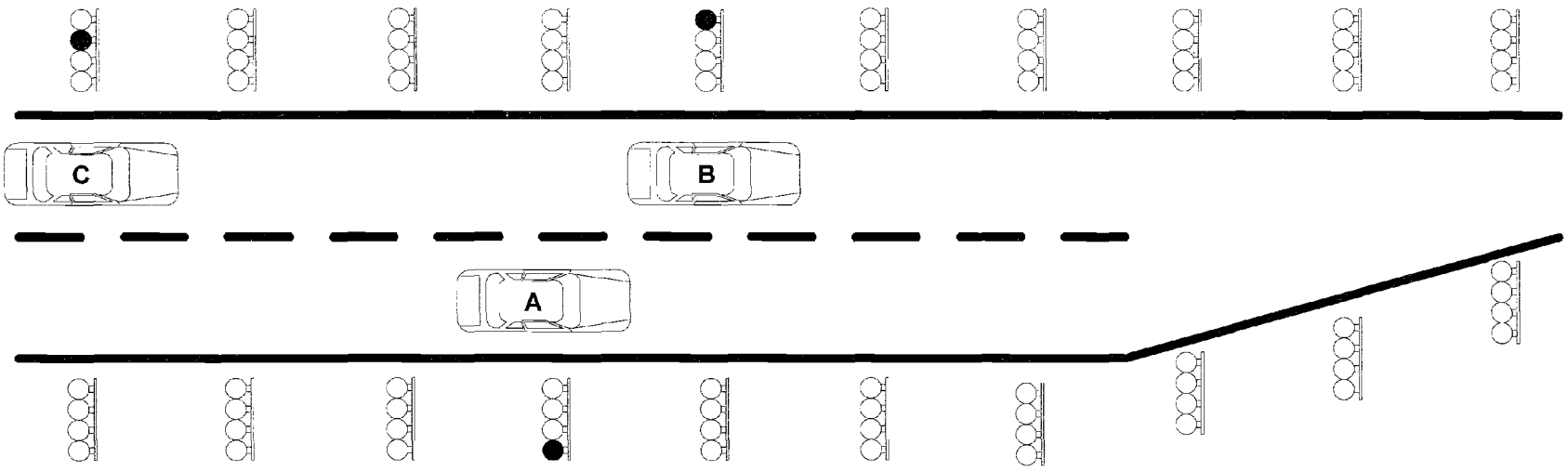
Figure 2D:
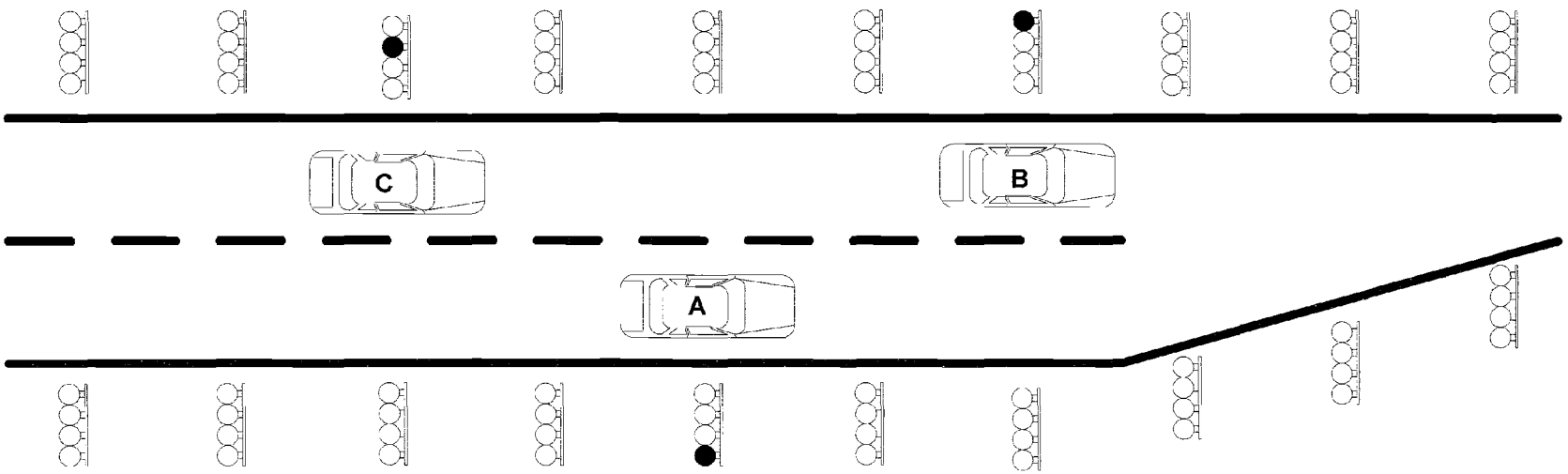
Figure 2E:
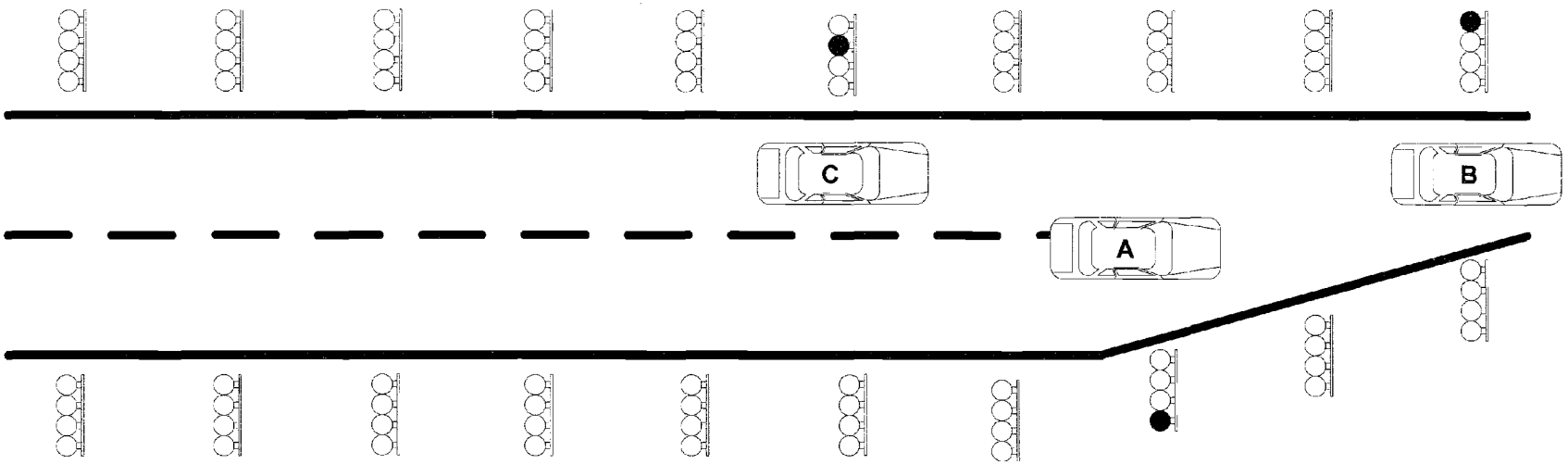
Figure 2F:
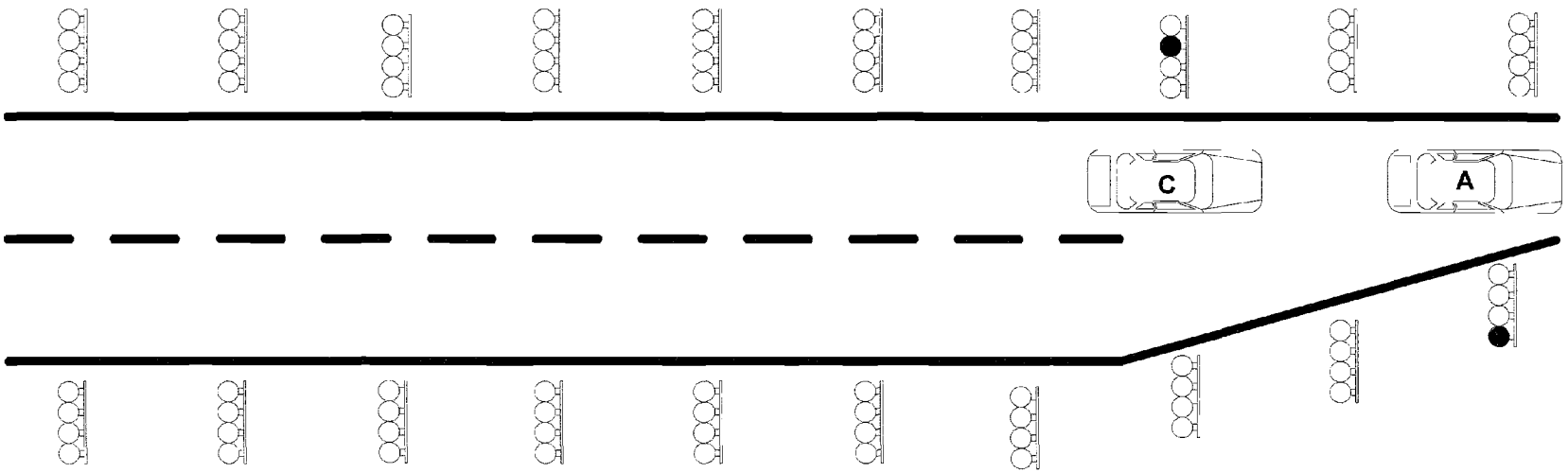

Referring now to FIGS. 2A-2F the operation of the system will be described. In FIG. 2A, vehicle "B" is traveling in the primary lane. The central controller (not shown) senses the speed of vehicle "B" using the speed sensors (also not shown). The controller commands primary lane signaling device (205) to flash (210). Vehicle "B" will pace its speed by arriving at subsequent primary lane signaling devices at the same time those devices flash, as shown in FIG. 2B, where primary lane signaling device (225) is flashing as vehicle "B" arrives. In this example, the controller would command the primary lane signaling devices to flash along the length of the primary lane to achieve a constant vehicle speed. Returning to FIG. 2A, vehicle "A" is traveling in the secondary lane and the central controller also senses the speed of this vehicle. The controller commands the secondary lane signaling device (215) to flash (220), and vehicle "A" strives to arrive at the subsequent secondary lane signaling devices at the same time the signal flashes. FIG. 2B shows vehicle "A" arriving at the subsequent secondary lane signaling device (230) at the same time the device is flashing. The controller manipulates the primary lane signaling devices and the secondary lane signaling devices so as to precisely pace each vehicle, thus allowing vehicle "A" to merge into the primary lane. In this example, the controller would command the secondary lane signaling devices to flash such that vehicle "A" will slow down (relative to the traffic in the primary lane) by just a few miles per hour and then accelerate until it reaches the same speed as that of the primary lane. Specifically, FIG. 2C illustrates that vehicle "A" has slowed relative to vehicle "B", which begins to create a space into which vehicle "A" can safely merge. Also, a new vehicle "C" has entered the picture and it also paces its speed using the primary lane signaling devices. Ultimately by FIG. 2D, the controller has effectively positioned all the vehicles through the use of the primary lane and the secondary lane signaling devices, such that vehicle "A" can begin to merge into the primary lane. At this point, the controller commands the secondary lane signaling devices to flash such that vehicle "A" begins to accelerate to reach the speed of the primary lane traffic, otherwise vehicle "C" will close the space into which vehicle "A" would like to merge. As shown in FIGS. 2E and F, all three vehicles are traveling at the same speed and vehicle "A" can safely merge into the primary lane of traffic.

Refinements may be added to the system. In the example described above, the system manipulated the speed of the secondary lane traffic more dramatically than the speed of the primary lane traffic. Of course, there may be some instances where the reverse could be more advantageous. If, for example, the secondary lane has more traffic than the primary lane, it might be more efficient to more dramatically control the speed of the primary lane. In any event, it may be advantageous to have more lane signaling devices for the lane that is subject to the more dramatic speed control because it would provide the motorist with more points of reference to effectively and safely manipulate their speed.

Figure 3:
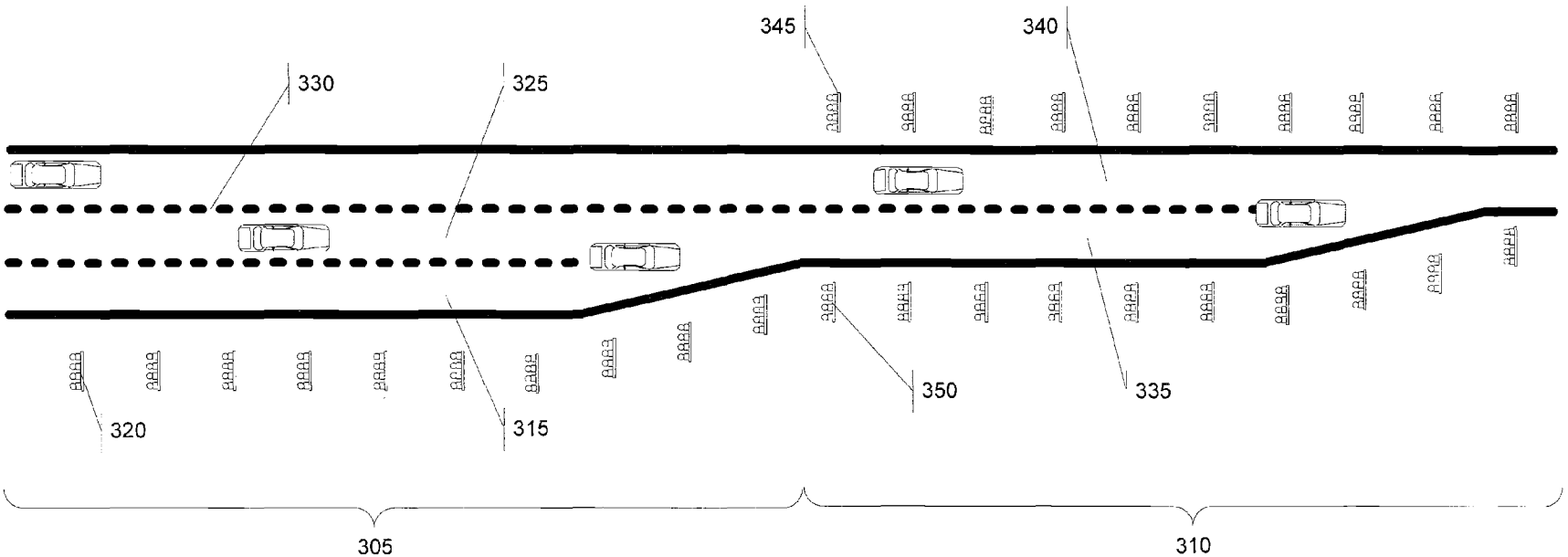
FIG. 3 depicts the novel traffic management system used to merge three lanes into one lane.

It should also be apparent that the system described above may be used to merge more than just two lanes into one. Referring to FIG. 3, the roadway is merging from three lanes into one. The roadway comprises two merge zones labeled 305 and 310. In the first merge zone (305), motorists in the secondary lane (315) take cues from the secondary lane signaling devices (320) and ultimately merge into the primary lane (325). Motorists in the primary lane (325) take their cues from the primary lane signaling devices (330) which in this case might be embedded in the roadway surface. Once a motorist in the primary lane (325) exits the first merge zone (305), the primary lane then becomes a secondary lane (335)—i.e., the zone-two secondary lane. The zone-two primary lane (340) takes its cues from a second set of primary lane signaling devices (345). Similarly, motorists traveling in the zone-two secondary lane (335) take their cues from a second set of secondary lane signaling devices (350). Of course, the just-described scheme can be expanded to accommodate as many lane merges as needed.

Several structures of the primary lane and secondary lane signaling devices would be apparent to those skilled in the art. For example, these signaling devices may be light emitting diodes (LED) or an incandescent light mounted on a series of standard portable high-impact plastic safety cones or drums and powered by long-life alkaline batteries, a portable power supply unit and/or a solar panel. These signals could be positioned far upstream of the merge and the sequencing of the signals could be controlled wirelessly. Because these signaling devices are portable, it may be advantageous to have each signaling device contain an integrated global positioning system (GPS) such that each device can communicate their precise location to the central controller. This would allow the central controller to more accurately generate the sequencing algorithms. In a permanent merge zone, the signaling devices may be permanent structures along the primary and secondary lanes. This could include lights embedded in the lane or structures along side of the lane.

The operation of the signaling devices can also be varied. For example, the signaling device may implement a standard red/yellow/green metering signal. As a motorist travels she should strive to arrive at the next signaling device when the green light flashes. If the motorist arrives when the light is yellow, then she will know that she just missed the proper timing and should slightly increase her speed to arrive at the next signal on time. Should the motorist arrive when the light is red, she will know that she is completely off in timing and should proceed with extreme caution. The benefit to the standard red/yellow/green metering signal is that it is familiar to motorists, such that they would more likely heed the signaling cues.

Intermittent flashing can be used to provide further signaling cues. In the red/yellow/green metering signal just described, a flashing red light intermittently could signal that the space along side the flashing red light is designated for a merging vehicle. Thus, a motorist traveling alongside a flashing red light must adjust its speed to avoid the merging vehicle. Intermittent flashing may be used to assist motorists in arriving at the signaling device at the optimal time. In one example, the light may flash with a long intermittent period and that period can shorten until the light becomes solid. A motorist would see the light flashing with a long intermittent period ahead and as the motorist comes closer the period would shorten until the light becomes solid once the motorist arrives at the signal. If the motorist were too fast or too slow, the motorist would know how to adjust her speed to reach the signaling device when the light flashes solid. The signaling devices may also incorporate a visual numerical countdown guide or other visual graphic display to cue motorists to effectively manipulate their vehicle speed to arrive at each light at the most optimal time.

Figure 4:
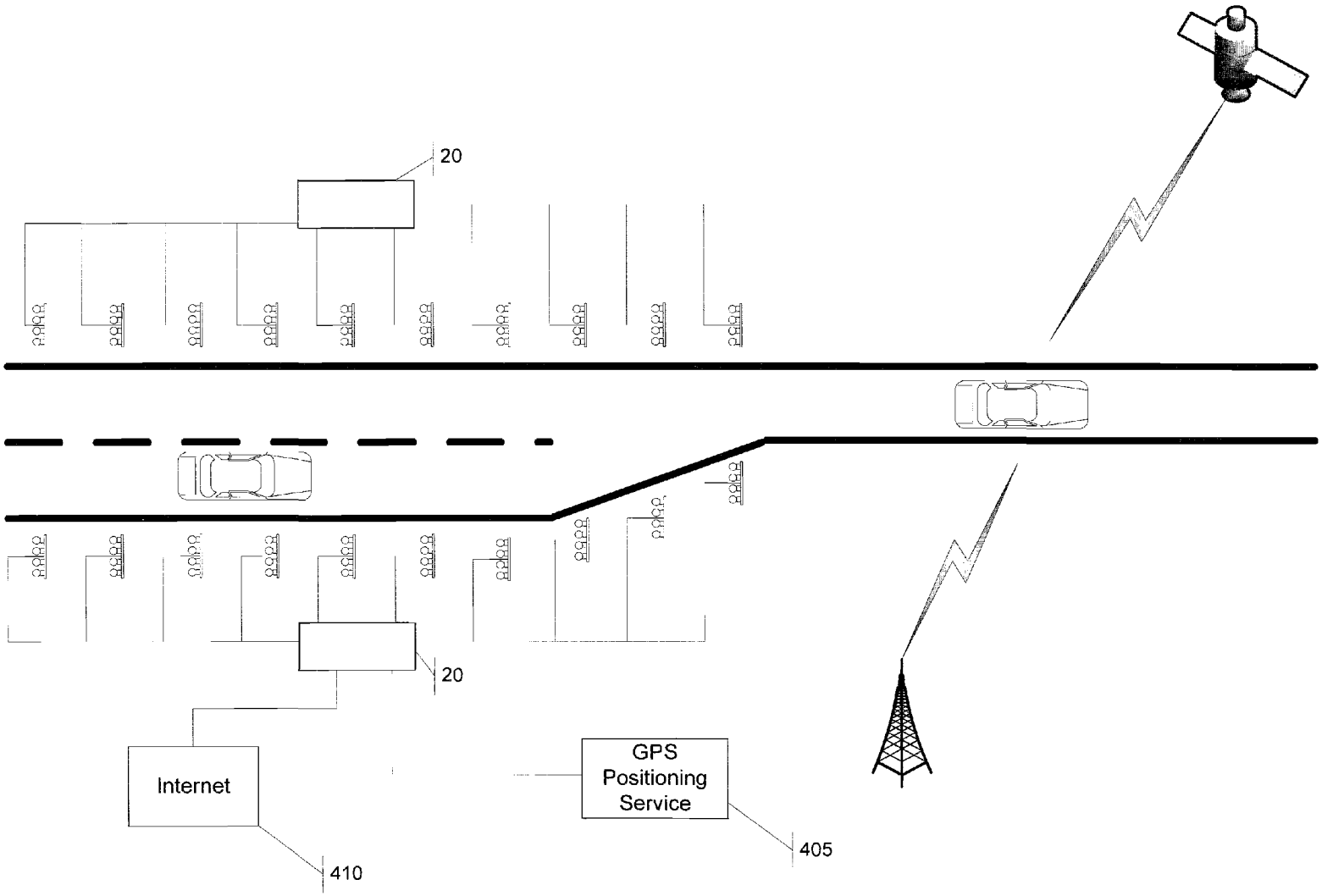
FIG. 4 illustrates external connections that may refine the novel traffic management system.

FIG. 4 illustrates several external connections that may further refine the present traffic management system. For example, the traffic management system may incorporate a global positioning system (GPS). The GPS may be satellite, terrestrial or a hybrid based system. Several vehicles are now currently equipped with GPS that allow of accurate and instantaneous tracking of the vehicle. One such service is SnapTrack and it is used by several commercial haulers. Even though this technology is available to a small portion of the vehicles, it could still be helpful in taking a representative sample how motorists are responding to the signaling cues. The central controller (20) may be connected to the GPS tracking service (e.g., SnapTrack) (405) and periodically query the service for GPS tracking information. From the information, the system may determine if the traffic is indeed responding to the signaling cues in an effective and efficient manner. For example, if the system determines through GPS positioning that vehicles are deviating from system cues, then it can make adjustments to refine the algorithm which may include reducing the overall merging speed or extending the merge zone. GPS positioning could also be used to more accurately place the signaling devices in the most efficient locations. Specifically, GPS positioning may reveal that traffic is bottlenecking further upstream from the merge than was previously thought. Thus, it could be necessary to extend the signaling devices even further upstream than its current position. FIG. 4 also illustrates the traffic management system connected to the Internet (410) for data uploading and downloading. For example, the central controller may be connected to the Internet (410) allowing the traffic management system to download appropriate traffic control algorithms in real time and/or uploading system operating data as well as traffic data to an off-site computer.

Now a traffic control trajectory will be described that may be used with the system described above. This trajectory is the same one as described above with regards to FIG. 2A-2F—i.e., the primary lane vehicle maintains a constant speed, while the traffic management system cues the secondary lane vehicle to slow down in order to fall behind the primary lane vehicle and then speed up so as to not cause any other primary lane vehicle to slow down. To construct appropriate acceleration, velocity and position trajectories for the vehicles, it is advantageous to make the following simplifying assumptions:

1. Equal vehicle flows in both lanes.
2. Synchronized arrival of vehicles.
3. Uniform spacing and speeds of vehicles in each lane.
4. Uniform vehicle population.
5. There is no congestion downstream of the lane drop.

Figure 5:
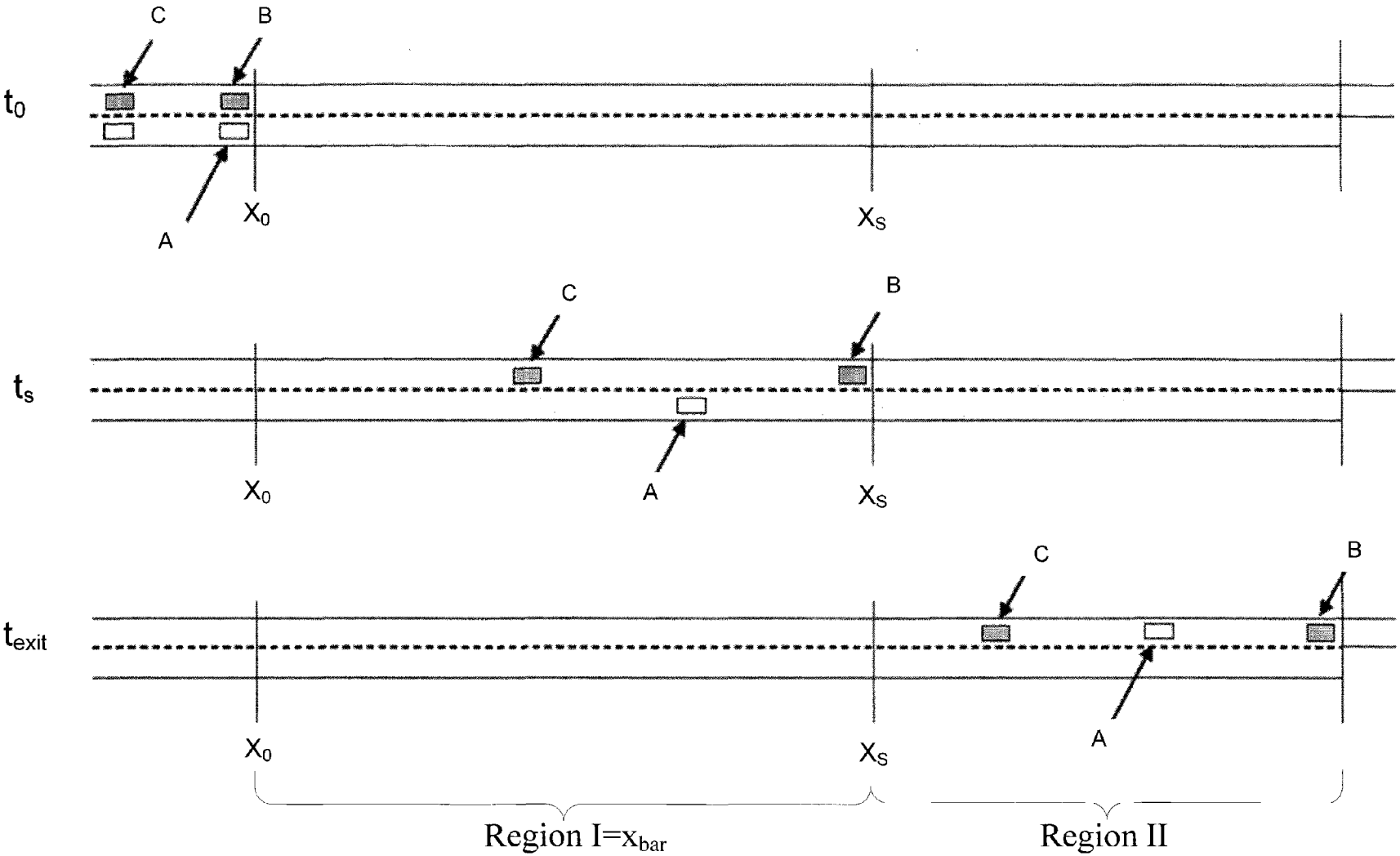
FIG. 5 is an illustration of the merge zone and how the vehicles merge into one lane with appropriate trajectories calculated by the novel traffic management system.

The scenario under these assumptions is shown graphically in FIG. 5. The merging zone contains three vehicles at a time: vehicles A, B, and C shown. The merging maneuver is divided into two parts that are carried out separately in regions I (the positioning region) and II (the merging region) of the merge zone, respectively. The objective of the first part is to create a sufficiently large gap between vehicles B and C, while positioning vehicle A for the lane change. The second part is the lane change itself. In the following equations, the following notation will be implemented:

| | |
|---|---|
| t: | time |
| x(t): | vehicle position. |
| v(t): | vehicle speed. |
| a(t): | vehicle acceleration. |
| s(t): | intervehicle spacing. |

-continued

| | |
|---|---|
| L: | Vehicle length. |
| $\bar{v}$: | maximum speed. |
| $\bar{a}$: | maximum acceleration. |
| $\tau$: | seconds between each vehicle entering the merge zone. |
| $v_0$: | initial speed of entering vehicles. |
| $\bar{s}$: | desired intervehicle spacing. |
| $\bar{x}$: | length of the positioning region. |
| $t_s$: | time at which the intervehicle spacing reaches $\bar{s} \Rightarrow s(t_s) = \bar{s}$ |
| $t_x$: | time at which the vehicle leaves the positioning region $\Rightarrow x(t_x) = \bar{x}$ |
| $t_v$: | time at which the vehicle reaches maximum speed $\Rightarrow v(t_v) = \bar{v}$ |

Before constructing a trajectory, it may be advantageous to determine whether it is even possible to open the required gap ($\bar{s}$), given the characteristics of the vehicles involved ($\bar{a}$; $\bar{v}$;L), the traffic conditions ($v_o$; $\tau$) and the available length of the positioning region ($\bar{x}$). The following should be true for feasibility: first, $\bar{s}<\bar{v}\,\tau$ (i.e., the desired gap must be less than the maximum space that can achieved at maximum speed) and second the following feasibility condition, which is derived below, should be true:

$$\bar{x} > \max\left\{\frac{\tau^2(\bar{v}^2 - v_o^2)}{4(\bar{v}\tau - \bar{s})}, \frac{\left(\bar{s} + \frac{1}{2}\hat{a}\tau^2\right)^2 - (v_o\tau)^2}{2\hat{a}\tau^2}\right\}$$

where $\hat{a}$ is the modified maximum acceleration defined below by Eq. (40). Assuming it is feasible, then it is advantageous to determine whether acceleration is necessary. Acceleration may not be necessary if the initial spacing between vehicles B and C is sufficient. Stated another way:

$$a(t)=0 \text{ if } v_o\tau \geqq \bar{s}.$$

If acceleration is necessary, then a trajectory must be constructed and applied to vehicles B and C within region I. Choosing a constant acceleration profile $a(t)=\alpha$, the value of $\alpha$ must be determined. The intervehicular spacing s(t) is given by:

$$\begin{aligned} s(t) &= x(t) - x(t-\tau) \\ &= v_o t + \frac{1}{2}\alpha t^2 - v_o(t-\tau) - \frac{1}{2}\alpha(t-\tau)^2 \\ &= v_o\tau + \frac{1}{2}\alpha\tau(2t-\tau) \end{aligned} \tag{1}$$

The maneuver ends when $s(t_s)=\bar{s}$; thus using Eq. (1), $t_s$ is:

$$t_s = \frac{\bar{s} - v_o\tau}{\alpha\tau} + \frac{\tau}{2} \tag{2}$$

A few design criteria for the value of $\alpha$ should be observed. Firsts the final speed must be less than the maximum speed—i.e., $v(t_s)<\bar{v}$. Second, the applied acceleration must be less than the maximum acceleration—i.e., $\alpha^+<\bar{a}$ ($\alpha^+$ is the acceleration of vehicle A and is given by Eq. (21) below). And finally, the maneuver is to be completed in the shortest possible distance.

Generally the position and speed for a constant acceleration are given by:

$$v(t)=v_o+\alpha t \tag{3}$$

$$x(t)=v_o t+\tfrac{1}{2}\alpha t^2 \tag{4}$$

Using the expression for $t_s$, the final speed and position are given by:

$$v(t_s) = v_o + \frac{\bar{s} - v_o\tau}{\tau} + \frac{\alpha\tau}{2} \tag{5}$$

$$\begin{aligned} x(t_s) &= \bar{s} + x(t_2 - \tau) \\ &= \bar{s} + v_o\left(\frac{\bar{s} - v_o\tau}{\alpha\tau} - \frac{\tau}{2}\right) + \frac{1}{2}\alpha\left(\frac{\bar{s} - v_o\tau}{\alpha\tau} - \frac{\tau}{2}\right)^2 \\ &= \bar{s} - \frac{1}{2}v_o\tau + \frac{v_o}{\tau\alpha}(\bar{s} - v_o\tau) + \\ &\quad \frac{(\bar{s} - v_o\tau)^2}{2\alpha\tau^2} - \frac{\bar{s} - v_o\tau}{2} + \frac{1}{8}\alpha\tau^2 \\ &= \frac{1}{2}\bar{s} + \frac{1}{\alpha}\left[\frac{v_o(\bar{s} - v_o\tau)}{\tau} + \frac{(\bar{s} - v_o\tau)^2}{2\tau^2}\right] + \frac{\tau^2}{8}\alpha \\ &= \vdots \\ &= \frac{\tau^2}{8}\alpha + \frac{\bar{s}}{2} + \frac{\bar{s}^2 - (v_o\tau)^2}{2\tau^2}\frac{1}{\alpha} \end{aligned} \tag{6}$$

Using Eq. (5) to express $v(t_s)<\bar{v}$ as a condition on $\alpha$:

$$\alpha \leq \frac{2}{\tau}\left(\bar{v} - \frac{\bar{s}}{\tau}\right) \tag{7}$$

Taking a derivative of Eq. (6) with respect to $\alpha$, the value of acceleration for minimal maneuver distance is:

$$\alpha_{opt} = \frac{2}{\tau^2}\sqrt{\bar{s}^2 - (v_o\tau)^2} \tag{8}$$

Combining Eqs. (7) and (8), and the condition that the applied acceleration must be less than the maximum acceleration—i.e., $\alpha^+<\bar{a}$—yields an applied acceleration given by:

$$\alpha = \min\left\{\frac{2}{\tau^2}\sqrt{\bar{s}^2 - (v_o\tau)^2},\ \frac{2}{\tau}\left(\bar{v} - \frac{\bar{s}}{\tau}\right), \bar{a} - \frac{2(L+\bar{s})}{t_s^2}\right\} \tag{9}$$

While vehicles B and C implement this applied acceleration, vehicle A will follow a trajectory that will align it with the mid-point between vehicles B and C. This trajectory is shown in FIG. 6. In this example, a step profiled is implemented that increases from $\alpha^-$ to $\alpha^+$ at $t_m=t_s/2$.

A few design criteria for the values of $\alpha^-$ and $\alpha^+$ should be observed. First, the final time for both the primary and secondary lane is the same. Second, vehicle A's final position is the midpoint between vehicles B and C. Third, the final speed of vehicle A is the same as the final speeds of vehicles B and C.

The second criterion is expressed as follows:

$$x_A(t_s) = x_B(t_s) - \frac{1}{2}(L + \bar{s}) \tag{10}$$

where L is the length of the vehicle, $x_A(t)$ is the position of vehicle A, and $x_B(t)$ is the position of vehicle B. The third criterion is express as:

$$v_A(t_s)=v_B(t_s) \tag{11}$$

where $v_A(t)$ is the speed of vehicle A, and $v_B(t)$ is the speed of vehicle B.

Throughout the maneuver, vehicle A will fall behind vehicle B and then accelerate such that it ends up at the midpoint and with equal speed. This means that its acceleration must initially be less than vehicle B, in order to fall behind, and then be larger, in order to recover lost speed. The most simple trajectory that can meet these requirements is made of 2-parts with a step at the midpoint ($t_m=t_s/2$). This is shown in FIG. 6.

Recall that position and velocity are given by:

$$x_1(t_s)=v_o t_s+\tfrac{1}{2}\alpha_s^2 \tag{12}$$

$$v_1(t_s)=v_o+\alpha t_s \tag{13}$$

Computing the position and speed of vehicle A at times $t_m$ and $t_s$:

$$\begin{aligned} \upsilon_A(t_m) &= \upsilon_o + \alpha^- t_m \\ &= \upsilon_o + \frac{1}{2}\alpha^- t_s \end{aligned} \tag{14}$$

$$\begin{aligned} \upsilon_A(t_s) &= \upsilon_A(t_m) + \alpha^+(t_s - t_m) \\ &= \upsilon_o + \frac{1}{2}\alpha^- t_s + \frac{1}{2}\alpha^+ t_s \\ &= \upsilon_o + \frac{1}{2}t_s(\alpha^+ + \alpha^-) \end{aligned} \tag{15}$$

$$\begin{aligned} x_A(t_m) &= \upsilon_o t_m + \frac{1}{2}\alpha^- t_m^2 \\ &= \frac{1}{2}\upsilon_o t_s + \frac{1}{8}\alpha^- t_s^2 \end{aligned} \tag{16}$$

$$\begin{aligned} x_A(t_s) &= x_A(t_m) + \upsilon_A(t_m)(t_s - t_m) + \frac{1}{2}\alpha^+(t_s - t_m)^2 \\ &= \frac{1}{2}\upsilon_o t_s + \frac{1}{8}\alpha^- t_s^2 + \left(\upsilon_o + \frac{1}{2}\alpha^- t_s\right)\frac{1}{2}t_s + \\ &\quad \frac{1}{2}\alpha^+\frac{1}{4}t_s^2 \\ &= \upsilon_o t_s + \frac{1}{8}\alpha^- t_s^2 + \frac{1}{4}\alpha^- t_s^2 + \frac{1}{8}\alpha^+ t_s^2 \\ &= \upsilon_o t_s + \frac{1}{8}t_s^2(3\alpha^- + \alpha^+) \end{aligned} \tag{17}$$

Eqs. (10) and (11) can be used to deduce $\alpha^-$ and $\alpha^+$. Eq. (11) becomes:

$$\upsilon_o + \frac{1}{2}t_s(\alpha^+ + \alpha^-) = \upsilon_o + \alpha t_s \tag{18}$$

$$\therefore\ \alpha = \frac{1}{2}(\alpha^- + \alpha^{-+}) \tag{19}$$

That is, $\alpha$ is the mean of $\alpha^-$ and $\alpha^+$. Using Eq. (10):

$$\upsilon_o t_s + \frac{1}{8}t_s^2(3\alpha^- + \alpha^+) = \upsilon_o t_s + \frac{1}{2}\alpha t_s^2 - \frac{1}{2}(L + \bar{s}) \tag{20}$$

Using Eq. (19), this boils down to:

$$\alpha^+=\alpha+2(L+\bar{s})/t_s^2 \tag{21}$$

$$\alpha^-=\alpha<2(L+\bar{s})/t_s^2 \tag{22}$$

Given the trajectories shown in FIG. 6, once the vehicles exit Region I they should maintain their current speeds (which will maintain the gap) and vehicle A must merge into the primary lane. This is shown in FIG. 5 at time $t_{exit}$.

FIG. 7 illustrates acceleration, velocity and position trajectories using the equations derived above and the following initial conditions and constraints: L=5 m; $\bar{a}$=1 m/s$^2$, $\bar{v}$=20 m/s; $\bar{s}$=30 m; $\bar{x}$=100 m; $\tau$=3 s and $v_o$=4 m/s.

Now returning to the feasibility condition referenced in passing above, recall that the desired gap must be less than the maximum space that can achieved at maximum speed—i.e., $\bar{s}<\bar{v}\,\tau$. Other conditions must also be met including: first, the opening of the desired intervehicle spacing must be achieved in Region I ($t_s<t_x$); second, the maximum speed cannot be exceeded ($t_s<t_v$), and third, the over acceleration must be less than the maximum acceleration ($\alpha^+<\bar{a}$). Eq. (2) gives formulas for $t_s$, $t_x$, and $t_v$ are derived as follows:

$$x(t_\infty) = \bar{x} = \upsilon_o t_\infty + \frac{1}{2}\alpha t_\infty \tag{23}$$

$$\therefore\ \frac{1}{2}\alpha t_\infty + \upsilon_o t_\infty - \bar{x} = 0 \tag{24}$$

$$\therefore\ t_\infty = \frac{1}{\alpha}\left(\sqrt{\upsilon_o^2 + 2\alpha\bar{x}} - \upsilon_o\right) \tag{25}$$

$$\upsilon(t_\upsilon) = \bar{\upsilon} = \upsilon_o + \alpha t_\upsilon \tag{26}$$

$$\therefore\ t_\upsilon = \frac{\bar{\upsilon} - \upsilon_o}{\alpha} \tag{27}$$

Applying the first condition (i.e., $t_s<t_x$) to these equations yields $$\frac{\bar{s} - \upsilon_o\tau}{\alpha\tau} + \frac{\tau}{2} < \frac{1}{\alpha}\left(\sqrt{\upsilon_o^2 + 2\alpha\bar{x}} - \upsilon_o\right) \tag{28}$$

$$\vdots$$

$$\frac{1}{4}\tau^4\alpha^2 + \tau^2(\bar{s} - 2\bar{x})\alpha + (\bar{s}^2 - (\upsilon_o\tau)^2) < 0 \tag{29}$$

Solving for the two roots of this quadratic equation in $\alpha$:

$$\alpha_{1,2} = \frac{2}{\tau^2}\left(2\bar{x} - \bar{s} \pm \sqrt{(\upsilon_o\tau)^2 - 4\bar{s}\,\bar{x} + 4\bar{x}^2}\right) \tag{30}$$

This quadratic equation describes a bowl-shaped (convex) curve, because $$\frac{1}{4}\tau^4$$

is positive. Hence, the condition is satisfied when is between the two roots:

$$\frac{1}{2}\tau^2\alpha > 2\bar{x} - \bar{s} - \sqrt{(\upsilon_o\tau)^2 - 4\bar{s}\,\bar{x} + 4\bar{x}^2} \tag{31}$$

$$\frac{1}{2}\tau^2\alpha < 2\bar{x} - \bar{s} + \sqrt{(\upsilon_o\tau)^2 - 4\bar{s}\,\bar{x} + 4\bar{x}^2} \tag{32}$$

Applying the second condition (i.e., $t_s<t_v$) yields:

$$\frac{\bar{s}-\upsilon_o\tau}{\alpha\tau}+\frac{\tau}{2}<\frac{\bar{\upsilon}-\upsilon_o}{\alpha} \tag{33}$$

which simplifies to:

$$\frac{1}{2}\tau^2\alpha<\bar{\upsilon}\tau-\bar{s} \tag{34}$$

Applying the third and final condition (i.e., $\alpha^+<\bar{a}$) lead to a cubic equation in $\alpha$ whose analytical solution is extremely complex. To simplify, substitute $t_s$ with $t_v$. Because $t_s<t_v$, the resulting condition is stricter than the original:

$$\alpha<\bar{a}-\frac{2(L+\bar{s})}{t_s^2} \tag{35}$$

$$<\bar{a}-\frac{2(L+\bar{s})}{t_\upsilon^2} \tag{36}$$

$$=\bar{a}-\frac{2(L+\bar{s})}{(\bar{\upsilon}-\upsilon_o)^2}\alpha^2 \tag{37}$$

$$2(L+\bar{s})\alpha^2+(\bar{\upsilon}-\upsilon_o)^2\alpha-\bar{a}(\bar{\upsilon}-\upsilon_o)^2<0 \tag{38}$$

The range of positive $\alpha$'s that comply with this is:

$$\frac{1}{2}\tau^2\alpha<\frac{1}{2}\tau^2\hat{a} \tag{39}$$

where $\hat{a}$ is the modified maximum acceleration, and is computed as:

$$\hat{a}=\Phi\left(\sqrt{1+\frac{2\bar{a}}{\Phi}}-1\right) \tag{40}$$

$$\Phi=\frac{(\bar{\upsilon}-\upsilon_o)^2}{4(L+\bar{s})} \tag{41}$$

Notice that the three conditions boil down to four limits on the value of $$\frac{1}{2}\tau^2\alpha;$$

three upper bounds and one lower bound. It can be seen that, because $\bar{x}$ is typically large, Eq. (32) should never be more stringent than Eq. (34), so we can eliminate Eq. (32), resulting in two upper bounds and a lower bound. The problem is infeasible when the lower bound is larger that the two upper bounds, since in that case there is no feasible $\alpha$. The problem is feasible when:

$$2\bar{x}-\bar{s}-\sqrt{(v_o\tau)^2-4\bar{s}\bar{x}+4\bar{x}^2}<\bar{v}\tau-\bar{s} \tag{42}$$

and $$2\bar{x}-\bar{s}-\sqrt{(v_o\tau)^2-4\bar{s}\bar{x}+4\bar{x}^2}<\tfrac{1}{2}\tau^2\hat{a} \tag{43}$$

With some manipulation, these three conditions become:

$$\bar{x}>\max\left\{\frac{\tau^2(\bar{\upsilon}^2-\upsilon_o^2)}{4(\bar{\upsilon}\tau-\bar{s})},\ \frac{\left(\bar{s}+\frac{1}{2}\hat{a}\tau^2\right)^2-(\upsilon_o\tau)^2}{2\hat{a}\tau^2}\right\} \tag{44}$$

The feasibility determination at Eq. (44) can be used in the overall traffic management system to make the system more robust and efficient. FIG. 8 illustrates a method that uses the feasibility determination as part of the traffic management system. In step 805, the system obtains the variables needed by the feasibility determination, including $\tau$, $v_0$, $\bar{v}$, $\bar{a}$, $\bar{s}$, and $\bar{x}$. These variables are inputted into the feasibility equation described above and the system determines at step 810 whether the system can feasibly merge the vehicles. If the system determines that the merge is feasible, then at step 815 the system constructs trajectories for the primary and secondary lanes. These trajectories may include those described above. At step 820 the system sends appropriate commands to the primary and secondary lane signaling devices to cue signals consistent with the constructed trajectories. It should be noted that the feasibility determination should be continually made because the initial conditions may change, and so might the feasibility determination. For this reason, it may be advantageous for the system to loop through and continually make the feasibility determination with updated variables.

Returning back to step 810, should the system determine that given the current conditions the merge is not feasible, then the system may advantageously query whether it can change the conditions to attain feasibility. One such condition is $v_0$ (the speed of the vehicles entering the merge zone) and the system may have means to slow vehicles down upon entering the merge zone. For example, the systems may have a velocity reducing signal upstream of the merge zone directing traffic to reduce their speed. Another such condition is $\bar{x}$—i.e., the length of the positioning region. The system may have several primary and secondary lane signaling devices but given the current conditions (say very little traffic) the system might only activate the signaling devices on a shortened portion resulting in a shortened positioning region. When conditions become less favorable, the system may expand the portion on which it activates the signaling devices—thus extending the length of $\bar{x}$. At steps 825 and 830 the system determines whether it can change variables to attain feasibility. If the system can, then steps 835 and 840 change the variables and the system updates the variables and recalculates feasibility.

If the system cannot achieve feasibility, then at step 845 it would be advantageous for the system to send commands to the primary and secondary lane signaling devices to cue cautionary signals that would alert the motorists that they must merge with extreme caution. After cuing the cautionary signals in step 845, the system should still continually update the variables at step 805 and perform further feasibility determinations. It is very possible that once the system cues a cautionary signal, the traffic will begin to slow down, which directly affects the feasibility determination. In fact, a reduced $v_0$ (the speed of the vehicles entering the merge zone) would make it more feasible to achieve a safe merge. The system may obtain the variables in step 805 for several sources that may include road sensors (850), the Internet (855) and GPS tracking (860).

With proper trajectory algorithms and methods for controlling the sequencing of the primary lane and secondary lane signaling devices, the desired gap between consecutive motorists can be maintained. Motorists can be provided with instructional cues to keep pace with the signals in their particular lane. Ultimately as described above, traffic approaching a merge zone could be positioned to allow a smooth merge without the need for an abrupt slowdown and without the inevitable traffic jam just ahead of the merge.

Having described the methods and structures in detail and by reference to several preferred embodiments thereof, modifications and variations are possible without departing from the scope of the invention defined in the following claims. Moreover, the embodiments in the specification are not intended to be strictly coextensive.

The invention claimed is:

1. A vehicular traffic system for a merge zone, the merge zone comprising a secondary lane merging into a primary lane, the vehicular traffic system comprising:

a series of primary lane signaling devices constructed to direct consecutive vehicles traveling in the primary lane along a primary lane trajectory constructed to open a gap between the consecutive vehicles traveling in the primary lane until a time when the gap between the consecutive vehicles traveling in the primary lane reaches a minimum maneuver distance sufficient for merging a vehicle traveling in the secondary lane; and a series of secondary lane signaling devices constructed to direct the vehicle traveling in the secondary lane along a secondary lane trajectory constructed to position the vehicle traveling in the secondary lane at a midpoint between the consecutive vehicles traveling in the primary lane at the same time that the gap between the consecutive vehicles traveling in the primary lane reaches the minimum maneuver distance sufficient for merging the vehicle traveling in the secondary lane.

2. The vehicular traffic system of claim 1, the series of primary signaling devices and the series of secondary signaling devices comprising at least one of a visible light, a light emitting diode, an incandescent light, and a visual graphic display.

3. The vehicular traffic system of claim 1, the series of primary lane signaling devices communicating with a central controller by one of a physical connection and a wireless connection.

4. The vehicular traffic system of claim 1, the series of secondary lane signaling devices communicating with a central controller by one of a physical connection and a wireless connection.

5. The vehicular traffic system of claim 1 further comprising the primary lane trajectory constructed to maintain the gap between the consecutive vehicles traveling in the primary lane at the minimum maneuver distance beyond the time when the gap reaches the minimum maneuver distance.

6. A method for merging traffic in a merge zone, the merge zone comprising a secondary lane merging into a primary lane, the method comprising steps of:

receiving variables of traffic entering the merge zone;

calculating a feasibility condition from the variables;

determining from the calculated feasibility condition when it is feasible to merge the traffic;

constructing a primary lane trajectory and a secondary lane trajectory when the calculated feasibility condition indicates that merging the traffic is feasible;

sending the primary lane trajectory to a series of primary lane signaling devices to open a gap between consecutive vehicles traveling in the primary lane until a time when the gap between the consecutive vehicles traveling in the primary lane reaches a minimum maneuver distance sufficient for merging a vehicle traveling in the secondary lane; and sending the secondary lane trajectory to a series of secondary lane signaling devices to position the vehicle traveling in the secondary lane at a midpoint between the consecutive vehicles traveling in the primary lane at the same time that the gap between the consecutive vehicles traveling in the primary lane reaches the minimum maneuver distance sufficient for merging the vehicle traveling in the secondary lane.

7. The method of claim 6 further comprising sending commands to the series of primary lane signaling devices and the series of secondary lane signaling devices to cue cautionary signals when the feasibility condition indicates that merging the traffic is not feasible.

8. The method of claim 6, further comprising receiving the variables from at least one of a speed sensor, a Global Positioning System (GPS), a computer network, and the Internet.

9. The method of claim 6 further comprising performing at least one of the steps by a central controller.

10. The method of claim 6 further comprising the feasibility condition calculated to indicate that merging the traffic is feasible when $\bar{s}<\bar{v}\tau$ and when $$\bar{x} > \max\left\{\frac{\tau^2(\bar{v}^2 - v_o^2)}{4(\bar{v}\tau - \bar{s})}, \frac{\left(\bar{s} + \frac{1}{2}\hat{a}\tau^2\right)^2 - (v_o\tau)^2}{2\hat{a}\tau^2}\right\}$$

where t: time x(t): vehicle position v(t): vehicle speed

α(t): vehicle acceleration s(t): intervehicle spacing

L: Vehicle length $\bar{v}$: maximum speed $\bar{\alpha}$: maximum acceleration

τ: seconds between each vehicle entering the merge zone $v_o$: initial speed of entering vehicles $\bar{S}$: desired intervehicle spacing $\bar{x}$: length of the positioning region $t_s$: time at which the intervehicle spacing reaches $\bar{s} \Rightarrow s(t_s)=\bar{s}$ $t_x$: time at which the vehicle leaves the positioning region $\Rightarrow x(t_x)=\bar{x}$ $t_v$: time at which the vehicle reaches maximum speed $\Rightarrow v(t_v)=\bar{v}$ and $\hat{\alpha}$ is a function of the maximum acceleration.

11. The method of claim 10 further comprising $\hat{\alpha}$ defined by $$\hat{a} = \Phi\left(\sqrt{1 + \frac{2\bar{a}}{\Phi}} - 1\right) \Phi = \frac{(\bar{v} - v_o)^2}{4(L + \bar{s})}.$$

12. The method of claim 10 further comprising calculating a final vehicle speed $v(t_s)$ and a final vehicle position $x(t_s)$ from $$\upsilon(t_s) = \upsilon_o + \frac{\bar{s} - \upsilon_o\tau}{\tau} + \frac{\alpha\tau}{2}$$

$$x(t_s) = \frac{\tau^2}{8}\alpha + \frac{\bar{s}}{2} + \frac{\bar{s}^2 - (\upsilon_o\tau)^2}{2\tau^2}\frac{1}{\alpha}$$

for a primary lane acceleration $\alpha$ defined by $$\alpha = \min\left\{\frac{2}{\tau^2}\sqrt{\bar{s}^2 - (\upsilon_o\tau)^2},\ \ \frac{2}{\tau}\left(\bar{\upsilon} - \frac{\bar{s}}{\tau}\right),\ \ \bar{\alpha} - \frac{2(L+\bar{s})}{t_s^2}\right\}.$$

13. The method of claim 10 further comprising calculating secondary lane accelerations $\alpha^+$ and $\alpha^-$ defined as $$\alpha^+ = \alpha + 2(L+\bar{s})/t_s^2$$

and $\alpha^- = \alpha < 2(L+\bar{s})/t_s^2$.

14. The method of claim 6, the variables comprising one or more of vehicle entry speed, vehicle maximum speed, maximum vehicle acceleration, desired intervehicle spacing, time between each vehicle entering the merge zone, and length of merge zone.

* * * * *